US005250748A

United States Patent [19]

Suzuki

[11] Patent Number: 5,250,748

[45] Date of Patent: Oct. 5, 1993

[54] TONE SIGNAL GENERATION DEVICE EMPLOYING A DIGITAL FILTER

[75] Inventor: Hideo Suzuki, Hamamatsu, Japan

[73] Assignee: Yamaha Corporation, Hamamatsu, Japan

[21] Appl. No.: 395,199

[22] Filed: Aug. 14, 1989

Related U.S. Application Data

[63] Continuation of Ser. No. 139,659, Dec. 30, 1987, abandoned.

[30] Foreign Application Priority Data

Dec. 30, 1986 [JP] Japan ..... 61-311285

[51] Int. Cl.[5] ..... G10H 1/12

[52] U.S. Cl. ..... 84/661; 84/DIG. 9; 364/724.01

[58] Field of Search ..... 84/622-625, 84/661, 699, 700, 736, DIG. 9; 364/419, 724.01-724.2; 381/41-51, 61

[56] References Cited

U.S. PATENT DOCUMENTS 4,416,179 11/1983 Wachi ..... 84/622
4,419,919 12/1983 Kashio ..... 84/DIG. 9
4,548,119 10/1985 Wachi et al. ..... 84/622
4,554,858 11/1985 Wachi et al. ..... 84/622
4,679,480 7/1987 Suzuki ..... 84/DIG. 9
4,701,956 10/1987 Katoh ..... 381/61
4,738,179 4/1988 Suzuki ..... 84/623 X

*Primary Examiner*—Stanley J. Witkowski
*Attorney, Agent, or Firm*—Graham & James

[57] ABSTRACT

An address signal generation circuit generates an address signal which changes at a rate corresponding to tone pitch of a tone to be generated. This address signal consists of an integer section and a decimal section. A tone waveshape data generation circuit generates tone waveshape sampled data in response to the integer section of the address signal. A filter coefficient supply circuit can generate data corresponding to filter coefficients of m orders and selects and supplies n filter coefficients (where $n<m$) in response to the decimal section of the address signal. In a relation $n=m/d$, for example, the filter coefficient supply circuit selects filter coefficients corresponding to n orders which are distant sequentially with an interval of d in response to the value of the decimal section of current address signal. A digital filter operation circuit performs filter operations of m orders with respect to tone waveshape data of n sample points by using these n filter coefficient data and tone waveshape data of n sample points generated by the tone waveshape data generation circuit. By this arrangement, despite that the actual filter operation is carried out only with respect to data corresponding to the n orders, a filter operation equivalent to performing filter operations of m orders can be realized.

11 Claims, 8 Drawing Sheets

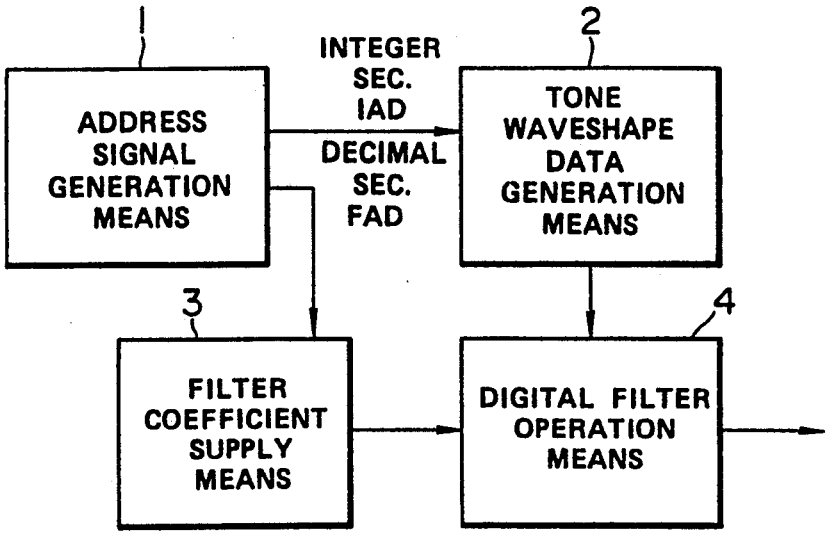
FIG. 1
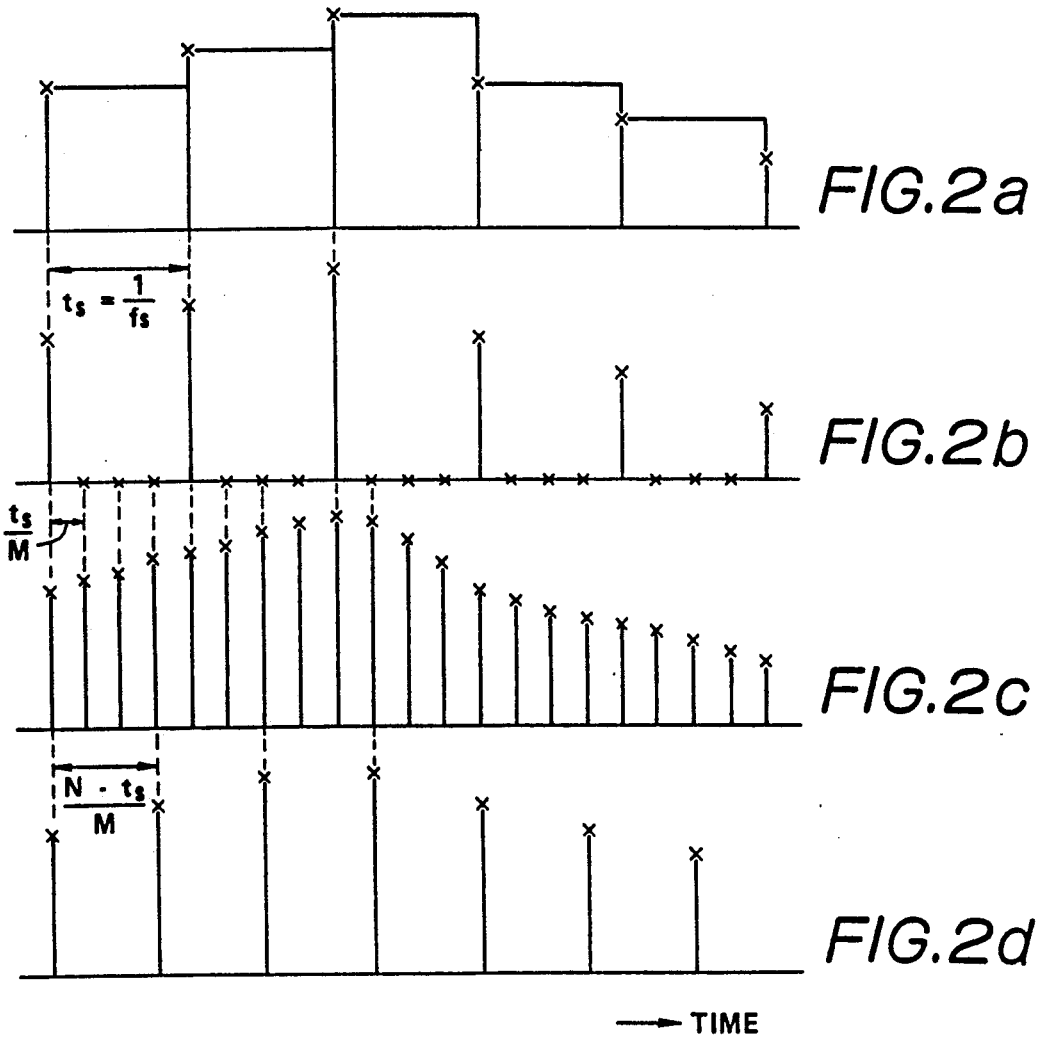

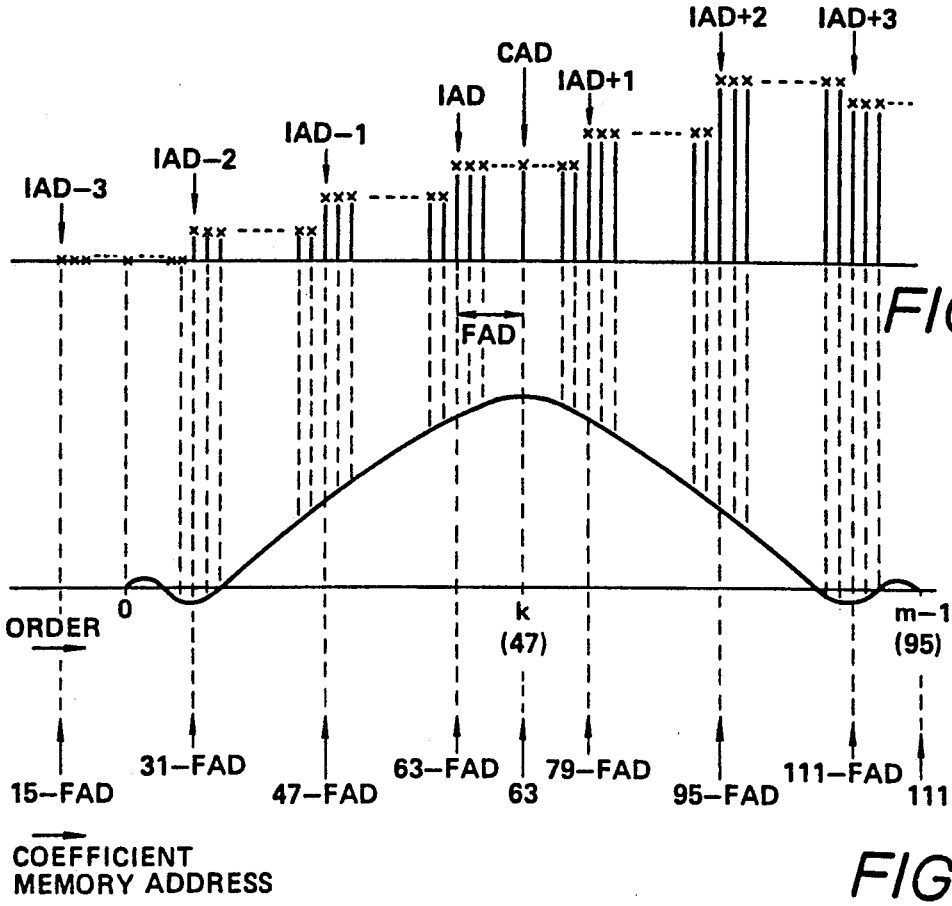
FIG.10a
FIG.10b
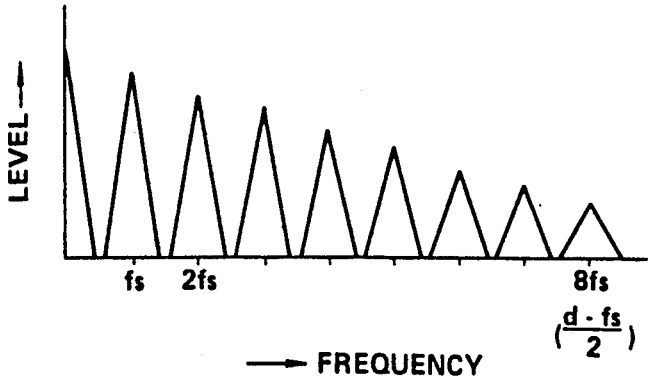
FIG.10c

TONE SIGNAL GENERATION DEVICE EMPLOYING A DIGITAL FILTER

This is a continuation of application Ser. No. 07/139,659, filed on Dec. 30, 1987, and now abandoned.

BACKGROUND OF THE INVENTION

This invention relates to a tone signal genration device performing removal of an aliasing noise and tone color control utilizing a digital filter operation and, more particularly, to a tone signal generation device capable of performing a digital filter operation of a good quality with a relatively simple hardware struccture.

In an electronic musical instrument, a digital filter is utilized for controlling the tone color of a digital tone signal or removing noise. For example, in a tone synthesis method called a pitch non-synchronizing type tone synthesis method according to which a tone signal is synthesized by conducting sampling with a constant sampling frequency irrespective of the frequency of a tone to be synthesized, the frequency of the tone and the sampling frequency are generarlly in non-integer ratio relation and, accordingly, as will be apparent from the sampling theorem, an aliasing noise which is not harmonic with the tone frequency tends to be generated and removal of such aliasing noise becomes necessary. For removing such aliasing noise contained in a pitch non-synchronizing type tone signal, it has been proposed to cause a tone signal to pass through a digital filter of characteristics capable of removing the aliasing noise (Japanese Preliminary Patent Publication No. 90514/1986 which corresponds to U.S. Pat. No. 4,701,956).

In such method according to which a tone signal is caused to pass though a digital filter for the removal of aliasing noise, a filter operation of high accuracy must be performed by using a sufficiently large number of filter orders. This however poses the problem that it necessitates a complicated filter construction. If, for example, the digital filter is one of 96 orders, filter operations for all of the 96 orders must be performed so that a circuit design enabling all of such filter operations must be employed. The same problem arises in not only a digital filter for removing aliasing noise but digital filters for tone color control and other purposes, i.e., in the prior art digital filters, filter operations must be performed for all orders if desired filter characteristics should be realized.

SUMMARY OF THE INVENTION

It is, therefore, an object of the invention to provide a tone signal generation device which, in perfoming tone color control or removing of aliasing noise by utilizing a digital filter, can perform a filter operation of high accuracy with a relatively simple hardware structure.

The tone signal generation device according to the invention comprises address signal generation means for generating an address signal consisting of an integer section and a decimal section, the value of said address signal changing at a rate corresponding to tone pitch of a tone to be generated, tone waveshape data generation means responsive to said integer section for generating tone waveshape in the form of sampled value, filter coefficient supply means capable of supplying m filter coefficients for selecting and supplying n filter coefficients from among said m filter coefficients in respect to said decimal secion (where $n<m$), and digital filter operation means having an m-order structure for digital filtering said tone waveshape by performing filter operation of m orders with respect to n sampled values of said tone waveshape in accordance with said n filter coefficients.

The address signal generation means generates an address signal consisting of an integer section and a decimal section and changes at a rate corresponding to tone pitch of a tone to be generated. As is generally known, the integer section of an address signal is of a coarser resolution than the decimal section thereof. The tone waveshape data generation means generates tone waveshape sampled data in accordance with the integer section of thin address signal. The resolution of the tone waveshape sampled data prepared by the tong waveshape data generation means therefore may be of a relatively coarse one. For example, tone waveshape sampled data may be prepared with accuracy in the order of 64 division per one period of a waveshape as in the prior art pitch synchronizing type tone signal generation device. The sampling frequency in this case may either be in synchronization with the pitch or not in synchronization with it. In the pitch non-synchronizing type tone signal generation device, the tone waveshape sampled data may be prepared with resolution which is as coarse as the one used in the pitch synchronizing type one.

For example, in the prior art pitch non-synchronizing type tone signal generation device, it is a general practice for eliminating the adverse effect of aliasing noise to a maximum extent to increase the resolution of waveshape and increase the sampling frequency. For example, waveshape data is generally prepared with an accuracy of 1,000 to 16,000 division per one period of a waveshape. Such accuracy requires a waveshape memory of a relatively large capacity. Due to the requirement for a waveshape memory of such large capacity, the method of increasing the sampling frequency is unsuitable for a tone signal generation system in which a waveshape of a relatively large section such as continuous waveshape of plural periods is stored in a waveshape memory and read out therefrom, though this method may be acceptable in a tone signal generation system in which a waveshape of a relatively short section such as a waveshape of one period only is stored in a waveshape memory and read out therefrom. On the other hand, in a tone signal synthesis method called a pitch synchronizing type tone synthesis method in which the sampling frequency is caused to be synchronized with the frequecny of a tone to be synthesized, the tone frequency (i.e., pitch) is in harmony with the sampling frequency and, accordingly, a component produced by aliasing is harmonized with the tone frequency and does not become a noise. Therefore, there arises little problem if waveshape data is prepared with a relatively coarse accuracy in the order of 64 divisions per one period of waveshape. Accordingly, this method is suitable for a tone signal generation system in which a waveshape of a relatively long seciton such as continuous waveshape of plural periods is stored in a memory and read out therefrom.

In contrast thereto, according to the invention, it will suffice if tone waveshape sampled data is prepared with resolution which is as coarse as the pitch synchronizing type tone signal generation system irrespective of whether the sampling frequency is synchronized with the pitch or not. Accordingly, this invention is suitable both for the tone signal generation system in which a waveshape of a relatively short section such as a waveshape of one period only is stored in a waveshape memory and read out therefrom and for the tone signal generation system in which a waveshape of a relatively long section such as waveshape of plural period is stored in a waveshape memory and read out therefrom.

The filter coefficient supply means selects and supplies, in response to the decimal section of the address signal, n coefficient data from among coefficient data corresponding to filter coefficients of m orders (where $n<m$). The digital operation means performs filter operations for m orders with respect to tone waveshape data of n sample points by using tone waveshape data of n sample points generated by the tone waveshape data generation means. By this arrangement, filter operation is performed which is equivalent to implementing accurate filter operations of m orders (despite that filter operations of n orders are actually performed) with respect to tone waveshape sampled data of high accuracy (this is not actually prepared by the tone waveshape data generation means) having resolution of the decimal section of the address signal. A theoretical explanation in this respect will be made later.

Owing to the foregoing structure, the following advantages will be brought about: (1) Since the resolution of tone waveshape sampled data prepared actually by the tone waveshape sampled data generation means may be a relatively coarse one corresponding to the integer section of the address signal, the circuit design can be simplified, (2) Since filter operations may be actually performed with respect to orders of a limited number corresponding to waveshape data of n sample points which is smaller than m, simplification of the digital filter circuit can be realized, (3) Since the actual filter operation becomes equivalent to performing accurate filter operations of m orders with respect to tone waveshape sampled data having resolution of the decimal section of the address signal, various benefits brought about by an accurate filter operation with respect to tone waveshape data of high resolution, e.g., accurate cutting off of unnecessary noise component with resulting production of a tone signal of a good quality, can be obtained.

In one aspect of the invention, the filter coefficient supply means is capable of supplying a filter coefficient group value corresponding to a total of one or more filter coefficients among filter coefficients of m orders and selects and supplies, in response to the decimal section of the address signal, n ($n<m$) filter coefficient group values as the coefficient data. By this arrangement, the above described advantages can be achieved and besides the accuracy in the filter operation can be further increased without making the hardware structure more complicated. By operating a filter coefficient value corresponding to a total of plural filter coefficients with respect to tone waveshape data of one sample point, the filter operation itself can be completed by a single operation but, nevertheless, it becomes equivalent to operating filter coefficients constituting filter coefficient group values individually and separately with respect to continuous plural sampled data of the same value (i.e., plural sampled data held at the 0-th order) with a result that the level of an aliasing component thereby is attenuated and the quality of the tone signal is improved.

Preferred embodiments of the invention will now be described with reference to the accompanying drawings.

BRIEF DESCRIPTION OF THE DRAWINGS

In the accompanying drawins,

FIG. 1 is a block diagram showing a basic structure of an embodiment of the tone signal generation device according to the invention;

FIGS. 2*a*–2*d* are waveshape diagrams showing an example each of waveshape sampled data at respective stages based on the general sampling frequency conversion theory;

FIGS. 10*a*–10*c* are diagrams for explaining a digital filter operation in another embodiment of the invention;

DESCRIPTION OF PREFERRED EMBODIMENTS

Figures 3A, 3B, 3C, 3D, 3E:
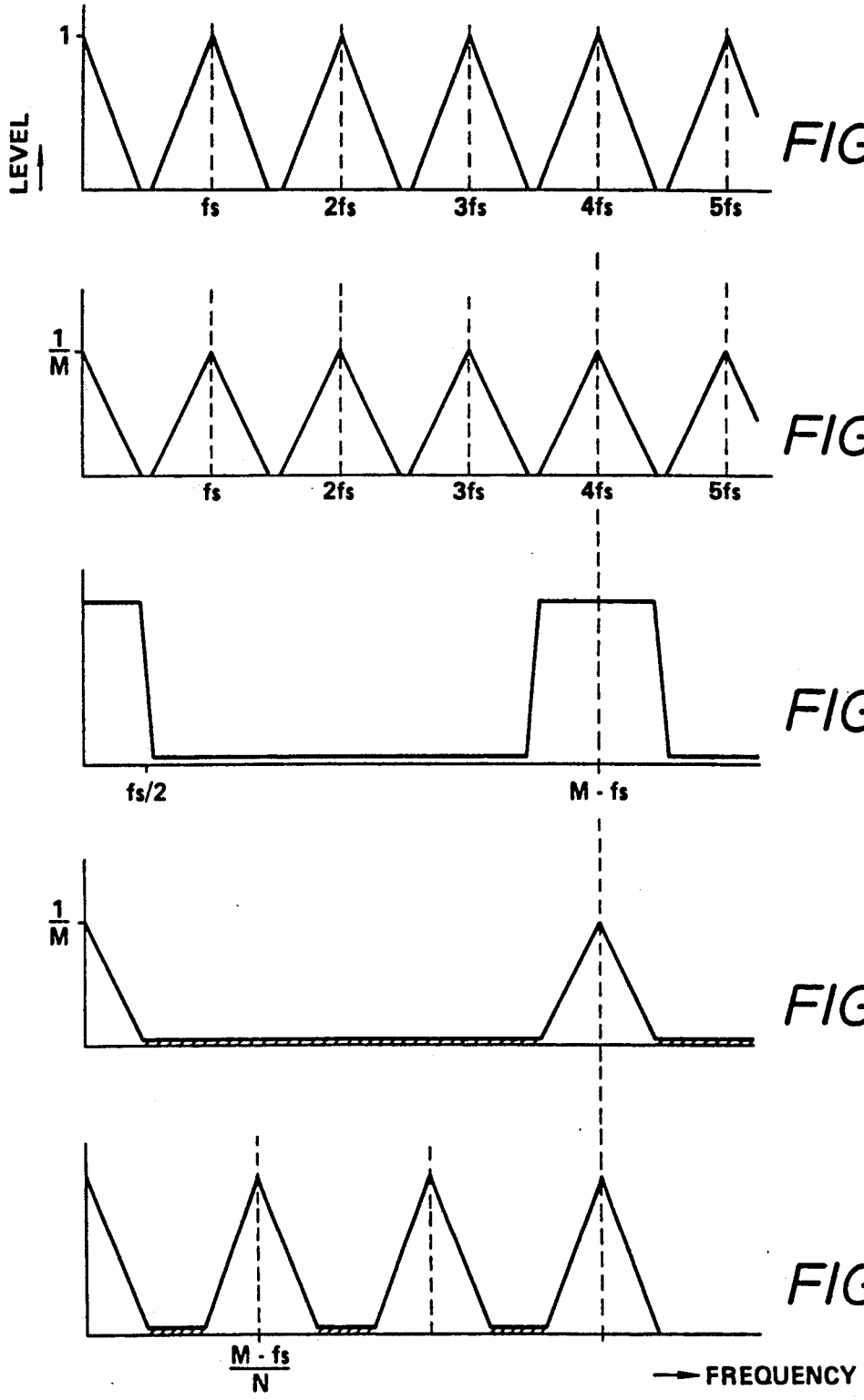
FIGS. 3*a*–3*e* are diagrams showing an example each of spectrum envelopes of the respective waveshape sampled data.

FIG. 1 is a basic block diagram showing an embodiment of the invention. Reference character 1 designates address signal generation means, 2 tone waveshape data generation means, 3 filter coefficient supply means and 4 digital filter operation means. As described previously, the address signal generation means 1 generates an address signal consisting of an integer section IAD and decimal section FAD at a rate corresponding to tone pitch of a tone to be generated. The tone waveshape data generation means 2 generates tone waveshape sampled data in response to the integer section IAD of the address signal. The filter coefficient supply means 3 selects and supplies n filter coefficients among filter coefficients of m orders ($n<m$) in response to the decimal section FAD of the address signal. The digital filter operation means 4 performs filter operations for m orders with respect to tone waveshape data for n sample points, using these n filter coefficients and tone waveshape data for n sample points generated by the tone waveshape data generation means.

In this embodiment, sampling frequency fs is constant irrespective of pitch of a tone to be generated (i.e., pitch non-synchronizing type) and the digital filter operation means 4 realizes low-pass filter characteristics using a frequency of fs/2 as cut-off frequency for removing an aliasing noise.

For explaining basic principle of the tone signal generation device according to the invention, the operation of the digital filter which constitutes a prerequisite to the invention will be described first with reference to FIGS. 2a-2d and 3a-3e.

FIGS. 2a-2d show an example of waveshape diagram based on the general sampling frequency conversion theory and FIGS. 3a-3e show an example of its spectrum envelope.

FIG. 2a is a diagram showing an example of the tone waveshape sampled data sampled with the sampling frequency fs with respect to some sample points.

Let us assume that the tone waveshape sampled data of FIG. 2a is applied to a digital filter which operates at a sampling timing with a frequency (M·fs) which is M times as large as the sampling frequency fs of the data. In this case, there are M periods ts/M of the frequency M·fs in one period ts=1/fs of the sampling frequency fs. The sampled data is not generated at all of M filter operation timings in one sampling time of the tone waveshape sampled data of FIG. 2a but the sampled data is generated at only one timing among M filter operation timings in one period ts of the sampling frequency fs and the sampled value is "0" at the remaining timings M−1. This example in which the tone waveshape sampled data of FIG. 2a is generated at a rate of one timing per M sampling timing of the frequency M. fs and the sampled value is "0" at the remaining timings of M−1 per M is shown in FIG. 2b.

This tone waveshape sampled data of FIG. 2b is applied to the digital filter where filter operation is performed at the sampling timing of the frequency M·fs. Alternatively stated, filter coefficients of respective orders are operated with respect to tone waveshape data at sample points at which one sampling frequency is ts/M (which data should have effective sampled value at one sampling timing per m timings and sampled value of "0" at the remaining M−1 timings per M timings). By this arrangement, as shown in FIG. 2c, tone waveshape data in which sampled values are densely generated in correspondence to the respective sampling timings of M·Fs. This is because filter operation is performed at each sampling timing of the frequency M·fs and, in the filter operation at each sampling timing, an output signal is obtained by convolution sum of each filter order and a corresponding sampled value.

By resampling tone waveshape data in which sampled value have been densely generated as shown in FIG. 2c with a desired sampling frequency, tone waveshape sampled data which has been coverted to a desired sampling frequency can be obtained. FIG. 2d shows an example of tone waveshape data obtained by such resampling with a desired sampling frequency. In this case, if the desired sampling frequency which should be resampled is M·fs/N, this frequency can be obtained by resampling the waveshape data of FIG. 2c at a rate of once in N times of the sampling timing of M·fs.

By the above described processing, tone waveshape data with the sampling frequency fs can be resampled to the sampling frequency of M·fs/N. In the illustrated example, M is 4 and N is 3.

FIG. 3a is a diagram showing an example of spectrum envelope of the waveshape of FIG. 2a and FIG. 3b is a diagram showing an example of spectrum envelope of the waveshape of FIG. 2b. The shape of the spectrum envelope is the same in FIGS. 3a and 3b but the level thereof in FIG. 3b is 1/M of that in FIG. 3a. This is because the number of effective sampled values (i.e., sampled values which are not "0") contained in the convolution sum is 1/M of the original number.

FIG. 3c shows an example of digital filter characteristics in which the digital filter is a low-pass filter having fs/2 as its cut-off frequency. FIG. 3d shows a spectrum envelope of the waveshape of FIG. 2c obtained by filtering with this low-pass filter characteristics. In this case, aliasing due to the sampling theorem occurs from the frequency of M·fs/2. This frequency is so high that the aliasing does not cause a noise in resampling. FIG. 3e shows an example of a spectrum envelope of the waveshape of FIG. 2d. Since the signal level after mere resampling of the filter output remains at the reduced level of 1/M as described before, the signal level is restored to the original one by multiplying the level of the waveshape of FIG. 2d by M in resampling.

In the above example, the digital filter is utilized for conversion of the sampling frequency and is not directly related to generation of a tone signal by establishing the tone frequency to a desired pitch. In contrast thereto, according to the invention, the digital filter operation based on the above principle is utilized in generating a tone signal of a desired pitch.

Figures 4A, 4B, 4C, 4D, 4E:
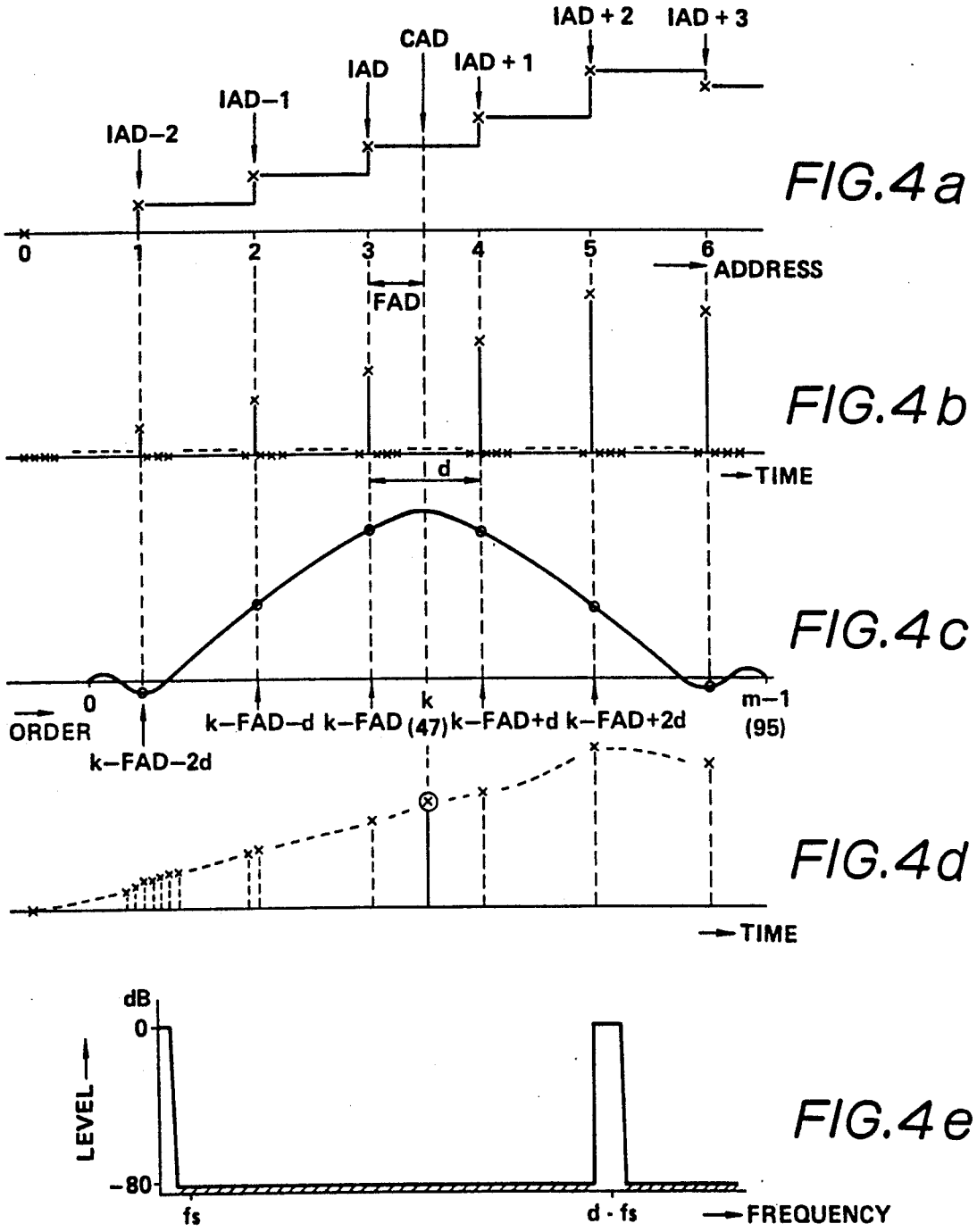
FIGS. 4*a*–4*e* are diagrams for explaining principle of the digital filter operation in the present invention.

More specifically, an address signal which changes at a rate corresponding to tone pitch of a tone to be generated is generated by the address signal generation means 1 and, in generating tone waveshape sampled data in response to this address signal, the digital filter operation based on the above principle is utilized. The address signal consists of an integer section IAD and a decimal section FAD and the tone waveshape data generation means 2 generates tone waveshape sampled data in response to this integer section IAD of the address signal. In other words, the tone waveshape sampled data which can be generated by this tone waveshape data generation means 2 corresponds only to resolution of the integer section IAd of the address signal. An example of tone waveshape sampled data generated by the tone waveshape data generation means 2 in response to the integer section IAD of the address signal is shown in FIG. 4a.

The decimal section FAD of the address signal represents a finer phase between adjacent sample points at a sample point determined by the integer section IAD of the address signal. If, for example, the present address value designated by the integer section IAD and decimal section FAD of the address signal is a phase indicated by CAD in FIG. 4a, the present value of the integer section IAD is for example "3" and the decimal section FAD is difference between CAD and IAD. That is, CAD=IAD+FAD.

For obtaining a tone waveshape signal of a good quality having little harmonic distortion, subharmonic distortion or noise, it is desirable to obtain tone waveshape sampled data with resolution of the decimal section FAD of the address signal, i.e., in correspondence to the phase of CAD. According to this invention, this can be realized with a simple circuit construction and without requiring a particularly high rate of sampling clock by utilizing the digital filter operation based on the above described principle. For this purpose, the filter coefficient supply means 3 selects and supplies n coefficient data from among coefficient data corresponding to filter coefficients of m orders (where n<m)

in accordance with the decimal section FAD of the address signal.

As will be apparent from the description relating to FIGS. 2*b* and 2*c*, it is not nucessary to supply tone waveshape sampled data in correspondence to all orders of the filter coefficients of plural orders but effective sampled data may be supplied at a rate of once every M orders and the sampled value of the sampled data may be "0" with respect to the remaining orders. Even in the latter case, an accurate filter operation is performed using filter coefficients of multiple orders so that a tone signal of a good quality can be obtained. On the basis of this principle, a digital filter operation based on a similar concept is performed in this invention. In the processing based on the above described general sampling frequency conversion theory, filter operations must actually be carried out with respect to filter coefficients of all orders in accordance with a high rate fitler operation timing (i.e., frequency M·fs), for, sicne correspondence between the order number and sampled data changes timewise as the operation timing changes, even if it is known that product of sampled data whose sampled value is "0" and a certain filter coefficient is "0", it is not known which order number it is related to. In the prior art processing according to general sampling frequency conversion theory, therefore, tone waveshape sampled data of the sampling frequency fs as shown in FIG. 2*a* is converted to data of the sampling frequency M fs by sampling once every M clocks of the sampling frequency M·fs and inserting "0" as a sampled value at sampling timings of M−1 times per M clocks, the converted data is applied to a digital filter operating with the frequency M·fs and filter operations must be actually carried out with respect to filter coefficients of all orders established in this digital filter.

In contrast thereto, this invention is characterized in that, utilizing the fact that an operation of sampled data whose sampled value is "0" and a filter coefficient corresponding thereto is actually unnecessary, such operation can be omitted. This obviates carrying out the filter operation at a high rate filter operation timing thereby enabling simplification of the operation circuit while enabling implementation of accurate filter operation using filter coefficients of sufficiently large number of orders. Thus, simplification of the circuit construction and improvement in the accuracy in the filter operation can be realized at the same time.

First, as in the relation shown in FIGS. 2*a* and 2*b*, it is assumed that tone waveshape sampled data shown in FIG. 4*a* is applied to a digital filter operating at a sampling timing whose frequency is M times that of sampling frequency fs of the tone waveshape sampled data so that M periods ts/M of frequency M·fs enter one period ts=1/fs of the sampling frequency fs and that sampled data is not generated at all of the M filter operation timings during one sampling time of the tone waveshape sampled data of FIG. 4*a* but sampled data is generated at one timing among the M filter operation timings during one period ts of the sampling frequency fs while sampled value becomes "0" at the remaining M−1 timings. Such example in which sampled values of the tone waveshape sampled data of FIG. 4*a* is generated at a timing of one per M among sampling timings of the frequency M·fs while the sampled value becomes "0" at the remaining M−1 per M timings is shown in FIG. 4*b*. If dividing number of the decimal section FAD of the address signal (i.e., number obtained by dividing 1 with minimum unit of the decimal section FAD, e.g., dividing number is 10 if the minimum unit of the decimal section FAD is 0.1) is represented by d, there is relation M=d.

Considering a case where filter operations of M orders are made with respect to tone waveshape sampled data shown in FIG. 4*b* (m being a desired number determined for establishing filter characteristics), a filter output signal of an accurate resolution similar to the one shown in FIG. 2*c* can be obtained with respect to the tone waveshape sampled data of FIG. 4*b* by performing filter operations at sampling timings of the frequency M·fs using all of filter coefficients of m orders as described previously with reference to FIG. 2. This however necessitates operation of the digital filter at the high rate sampling frequency M·fs and besides filter operations must be actually carried out with respect to filter coeffieicnts of all orders set in this digital filter. This is disadvantageous and cannot be adopted in this invention. Instead of employing this method, this invention utilizes the fact that the operation of sampled data whose sampled value is "0" and a corresponding filter coefficient is actually unnecessary and therefore omits this operation and besides performs filter operation without using a particularly high rate sampling frequency.

According to the invention, such omission of unnecessary operation can be achieved by dividing the address signal into the integer section IAD and the decimal section FAD and generating tone waveshape sampled data in accordance with the integer section IAD while selecting and supplying filter coefficients for the digital filter operation in accordance with the decimal section FAD. In other words, it is a feature of the invention that the generation of tone waveshape sampled data is performed with d relatively coarse resolution in accordance with the integer section IAD whereas the digital filter operation is performed with a fine resolution in accordance with the decimal section FAD. More specifically, by selecting filter coefficients in accordance with the decimal section FAD of the address signal, orders of filter coefficients corresponding to tone waveshape sampled data at sample points of a coarse sampling timing corresponding to the integer section IAD are determined as if the filter operation was being carried out at a fine sampling timing concerning the present phase CAD of the address signal consisting of the integer section IAD and the decimal section FAD. In other words, corresponding relation between sampled data at sample points corresponding to the integer section IAD and orders of filter coefficients is determined in accordance with the decimal section FAD of the address signal whereby orders of filter coefficients corresponding to fine sampling timing having "0" inserted as sampled value in the assumed case of FIG. 4*b* can be determined and, with respect to these orders, the orders of the filter coefficients can be treated in such a manner that their products are "0" so that filter coefficients corresponding to orders for sampled data having effective values have only to be skippingly operated. Thus, according to the invention, filter coefficients which the filter coefficient supply means 3 should supply in filter operation of orders m are not all coefficient data corresponding to the filter coefficient data of orders m but n coefficients among them (n<m) have only to be selected and supplied in accordance with the decimal section FAD of the address signal.

With regard to M in the sampling frequency M·fs of the assumed digital filter operation, M=d (the dividing number of the decimal section FAD) and the assumed sampled data of FIG. 4*b* is one in which the sampled data is generated at one timing only among the assumed filter operation timings obtained by dividing one sample interval of the tone waveshape sampled data of FIG. 4*a* by M=d and the sampled value is "0" at the remaining d−1 timings. Accordingly, the sampled data of FIG. 4*b* has an effective sampled value at one timing only among the assumed filter operation timings obtained by dividing one sample interval of the tone waveshape sampled data of FIG. 4*a* by d and actual operation has only to be performed with respect to this assumed filter operation timing only. Accordingly, the above described n can be determined from the relation n=m/d so that orders of n which are sequentially spaced with the interval of d may be selected in accordance with the decimal section FAD of the address signal. The operation may be performed only once every d times among timings of the sampling frequency M·fs=d·fs of the assumed digital filter operation and it is not necessary to perform the operation at other timings. In other words, unit delay of the sampled data need not be performed at the sampling frequency M·fs=d·fs but may be performed at the sampling frequency fs so that actual filter operation may be performed at the low rate sampling frequency fs notwithstanding that substantially accurate filter operation is performed at the sampling frequency M·fs=d·fs. In connection with this, although the sampled data as shown in FIG. 4*b* is assumed, the sampling once every d clocks of the sampling frequency M·fs=d·fs and the insertion of the sampled value "0" of d−1 times are actually not necessary at all but the sampled data generated in accordance with the integer section IAD of the address signal in response to the sampling frequency fs may be directly used.

This will be further illustated in the figures. The filter operation according to the invention is equivalent to performing a filter operation with respect to sampled data as shown in FIG. 4*b* in correspondence to the current phase CAD of the address signal. In this case, an example of correspondence between sampled data of FIG. 4*b* and respective orders (0-th order through m−1-th order) of the filter coefficients of m orders is shown in FIG. 4*c*. FIG. 4*c* shows in the form of an envelope an example of impulse response of low-pass filter characteristics of FIR (finite impulse response) filter of m orders. The frequency domain of this FIR filter is M·fs=d·fs and the cut-off frequency of the low-pass filter characteristics is set at fs/2 for removing aliasing noise concerning the sampling frequency fs. In this impulse response, a predetermined reference order (e.g., order at the center) is assumed to correspond to current phase CAD of the address signal. In the filter operation, convolution between sampled data of FIG. 4*b* and filter coefficients of FIG. 4*c* is obtained. In this case, filter operation is not performed with respect to sampled data whose value is "0" among sampled data of FIG. 4*b* in the frequency deomain of d fs. In other words, operation between sampled data having effective sampled values in FIG. 4*b* and filter coefficients of orders corresponding to the sampled data only is performed. From the relation that n=m/d, the number of sampled data having effective values in the convolution of orders m is n. In the illustrated example, it is assumed that m=96, d=16 and n=6. A sum of convolution obtained by filter operation carried out in correspondence to the current phase CAD of the address signal is shown by a solid line in FIG. 4*d*. As shown partly by a dotted line in FIG. 4*d*, such sum of convolution, i.e., a filter output signal, is densely generated in the same manner as shown in FIG. 2*c* in the frequency domain of d·fs. Since, in the same manner as was previously described, this convolution is actually performed only with respect to sampled data of n=6, the level of the filter output signal is reduced to 1/d=1/16 of the original level. This reduction in the level can be compensated if the level of the filter output signal is multiplied by d=16. Alternatively, the filter operation may be made using a filter coefficient having level of d=16 times.

Figure 5:
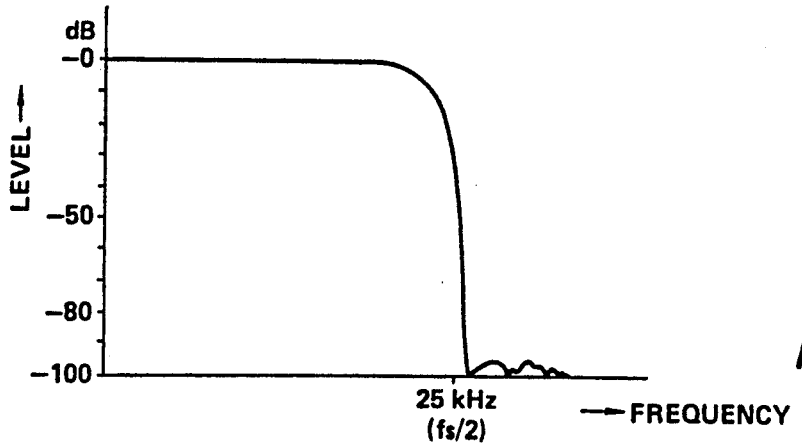
FIG. 5 is a diagram showing an example of actually measured amplitude-frequency characteristics of a FIR low-pass filter realized according to the invention.
Figure 6:
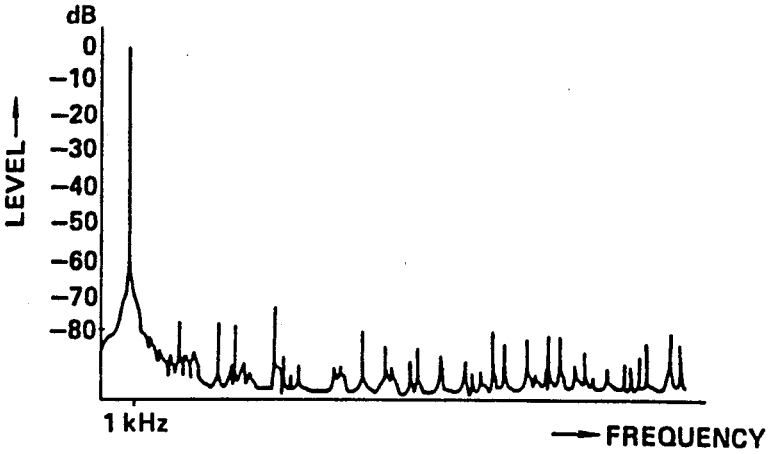
FIG. 6 is an example of actually measured spectrum of a sinusoidal wave signal which has passed through the low-pass filter of the characteristics shown in FIG. 5.

FIG. 4*e* shows an example of amplitude-frequency characteristics of FIR low-pass filter having -impulse response of FIG. 4*c*. From this figure, it can be ascertained that components of the cut frequency domain are attenuated to below −80 dB. This is relatively highly accurate filter characteristics. FIG. 5 is a diagram showing actually measured amplitude-frequency characterisitcs of such FIR low-pass filter. FIG. 6 shows actually measured spectrum of a sinusoidal wave signal passing through the FIR low-pass filter of the characteristics of FIG. 5. As will be apparent from this figure, noise components other than the fundamental wave are certainly attenuated to below −80 dB.

Summing up the relations illustrated in FIGS. 4*a*-4*c*, respective orders (from 0-th order to m−1-th order) of filter coefficients of orders m correspond to continuous values of the address signal with resolution of the decimal section FAD and a predetermined reference order (e.g., order k at the center) corresponds to position of the decimal section FAD of the current address signal (i.e., position of the current phase CAD). Orders of n which are spaced from the reference order by amounts corresponding to distances of the respective integer sections IAD of n sample points with respect to the decimal section FAD of the current address signal are skippingly determined and n filter coefficients corresponding to the n orders determined in accordance with the decimal section of the current address signal are supplied by the filter coefficient supply means 3.

If, for example, the reference order corresponding to the current phase CAD of the address signal is the order k at the center (e.g., the order k at the center is assumed to be 47-th order when m=96, i.e., all orders range from 0-th to m−1-th=95-th) and n is 6, "respective integer sections IAD of the current address signal" are integer sections of f=6 sample points before and after the integer section IAD of the current address signal, i.e., IAD−2, IAD−1, IAD, IAD+1, IAD+2 and IAD+3 shown in FIG. 4*a*. Orders of n=6 which are distant from the reference order (k−47-th) by amounts corresponding to distances of the respective integer sections of n sample points, i.e., IAD−2, IAD −1, IAD, IAD+1, IAD+2 and IAD+3, are generally determined skippingly as follows:

order corresponding to IAD−2: k−FAD−2*d*
order corresponding to IAD−1: k−FAD−d
order corresponding to IAD: k−FAD
order corresponding to IAD+1: k−FAD+d
order corresponding to IAD+2: k−FAD+2*d*
Order corresponding to IAD+3: k−FAD+3*d*

The above is just one example and different definitions are of course possible. In the above definition, different singular solutions may be produced depending upon determination of k, d and n. If, for example, k is 46 under the same condition, order corresponding to IAD−3 which is 3 samples before the integer section IAD of the current address signal must be determined under the definition of k−FAD−3*d*.

In the filter coefficient supply means 3, orders of n are determined in accordance with the decimal section FAD of the current address signal by means of the above described table or an operation circuit implementing the above formula and coefficient data corresponding to the n orders thus determined are provided.

Figure 7:
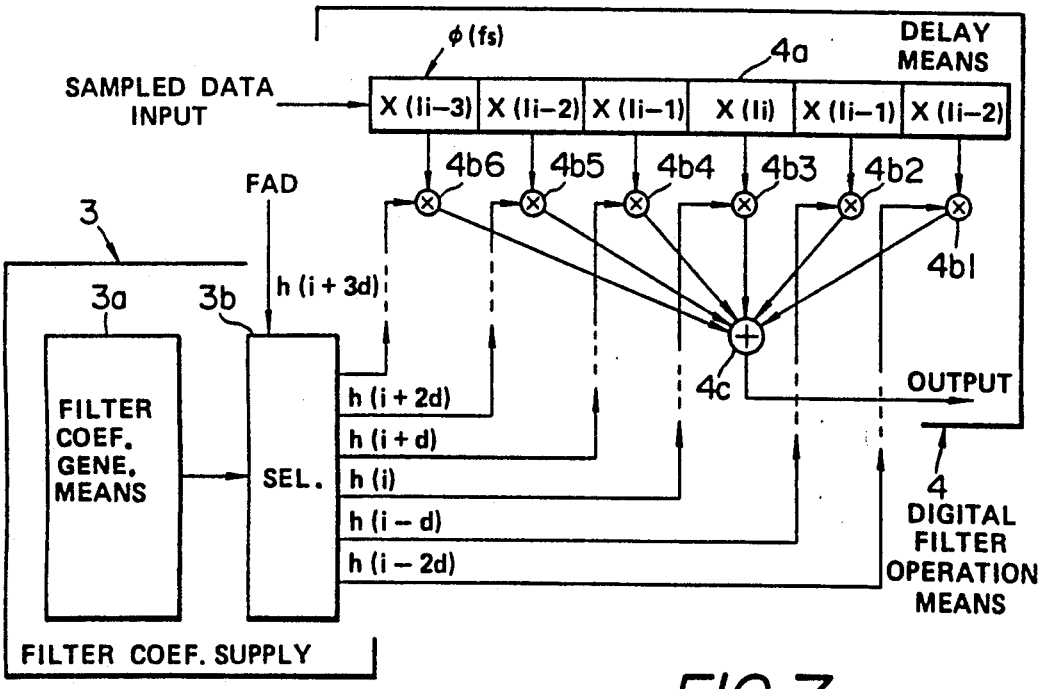
FIG. 7 is a block diagram showing an example of the filter coefficient supply means and the digital filter operation means in FIG. 1.

An example of internal structure of this filter coefficient supply means 3 and the digital filter operation means 4 is shown in FIG. 7 in some detail. The fitler coefficient supply means 3 comprises filter coefficient generation means 3*a* generating filter coefficients of orders m (from 0-th to m−1-th) and selection means 3*b* selecting n filter coefficients among these filter coefficients of orders m in accordance with value of the decimal section FAD of the address signal. Selection means 3*b* comprises for example the above described table and determines by this table orders k−FAD −2*d*, k−FAD−d, k−FAD, k−FAD+d, k−FAD+2*d* and k−FAD+3*d* corresponding to the respective integer sections IAD−2, IAD−1, IAD, IAD+1, IAD+2 and IAD+3 of n sample points and thereby selects and outputs filter coefficients h (i−2*d*), h(i−d), h(i), h(i+d), h(i+2*d*) and h(i+3*d*) corresponding to the skippingly determined orders.

In FIG. 7, the digital filter operation means 4 consists of an FIR filter and comprises delay means 4*a* which delays tone waveshape data generated by the tone waveshape data generation means 2 in response to the integer section IAD of the address signal by clock pulse (fs) of the sampling frequency fs. This delay means 4*a* supplies sampled data X(Ii−2), X(Ii−1), X(Ii), X(Ii+1), X(Ii+2) and X(Ii+3) corresponding to the respective integer sections IAD−2, IAD−1, IAD, IAD+1, IAD+2 and IAD+3. These sampled data X(Ii−2), X(ii−1), X(ii), X(Ii+1), X(Ii+2) and X(Ii+3) are applied to multipliers 4*b*1–4*b*6 where they are multiplied with the filter coefficients h(i−2d), h(i−d), h(i), h(i+d), h(i+2*d*) and h(i+3*d*). Outputs of the multipliers 4*b*1–4*b*6 are added together by an adder 4*c* and output of the adder 4*c* is provided as the output of the FIR filter. Since the sampled data X(Ii) which is treated as the current sample point is delayed by the delay means 4*a*, the filter coefficients h(i−2d) h(i+3*d*) supplied by the selection means 3*b* may be suitably delayed in accordance with the delay of sampled data X(Ii) and thereafter supplied to the multipliers 4*b*1–4*b*6.

Summing up the above described relations in FIGS. 4*a*–4*c* in an alternative expression, n (n=6 in the above example) is determined on the basis of the relation n=m/d in accordance with the dividing number d of the decimal section of the address signal (d=16 in the above example), n filter coefficients to be determined consist of coefficients respectively corresponding to n orders which are sequentially spaced with an interval of d, the n orders are determined in accordance with values of the decimal section FAD of the current address signal whereby n filter coefficients corresponding to n orders determined in accordance with the decimal section FAD of the current address signal are supplied from the filter coefficient supply means 3.

In the foregoing manner, according to the invention, filter operation may be performed only with respect to coefficient data of n=m/d in the convolution opeation of the filter of m orders instead of performing filter operation with respect to coefficient data of all of the m orders. Accordingly, the scale of operation can be reduced to 1/d. Moreover, despite the fact that the sampling frequency in actual operation is fs, a result equivalent to performing a digital filter operation with a high resolution of d·fs can be obtained.

Description will now be made about improvement in the accuracy of filter operation without excessively enlarging the scale of the circuit construction. For performing filter operations of q·m orders, i.e., using filter coefficients of m orders and performing filter operations of q times thereof, interpolation with resolution of q is performed between adjacent ones of filter coefficients of m orders whereby filter coefficients of q·m orders are densely generated. By such interpolation of q times, equivalent sampling frequency in the digital filter operation becomes a high resolution of q·d·fs so that filter orders become q·m whereby the accuracy of the filter operation can be greatly improved.

A more specific embodiment of the present invention will be described with reference to FIG. 8.

Figure 8:
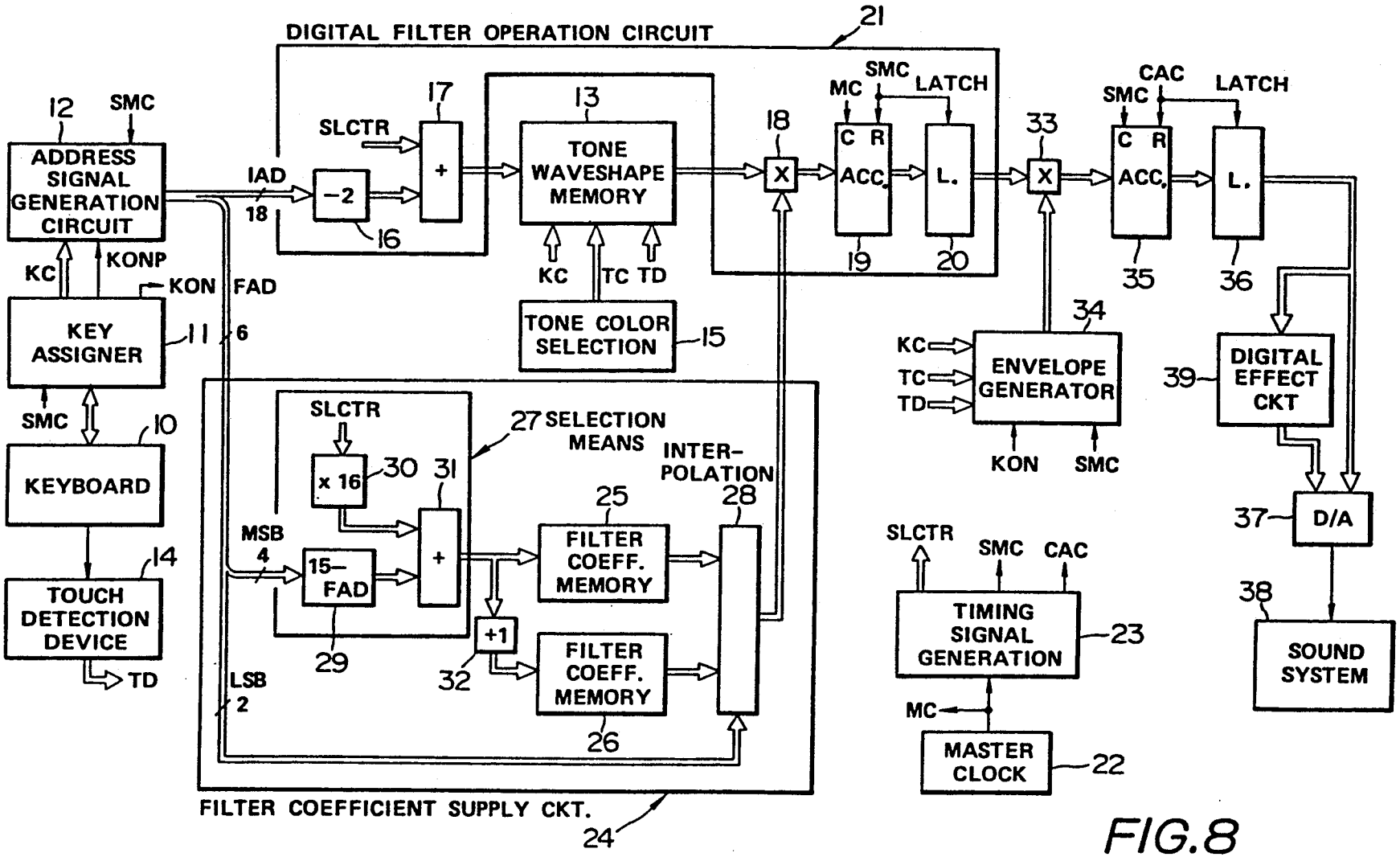
FIG. 8 is a block diagram showing a more specific embodiment of the tone signal generation device according to the invention.

In the embodiment of FIG. 8, the dividing number of the decimal section FAD of the address signal is d=16, filter orders m are m=96 and n=6. Further, interpolation of resolution q=4 is performed between adjacent ones of filter coefficients of m orders and filter coefficients of q·m orders =384 orders are densely generated. The decimal section FAD of the address signal, thereofore, consists basically of 4-bit data corresponding to the dividing number d=16=$2^4$ and less significant 2 bits are added thereto so that interpolation step of resolution q=4 is designated. Accordingly, in the case of this embodiment, the decimal section FAD of the address signal consists of 6 bit data. The sampling frequency is fixed to fs=50 kHz and a tone signal is generated not in synchronization with the pitch. In this embodiment, the digital filter is constructed as an FIR filter of low-pass filter characteristics for removing aliasing noise as in the previously described embodiment.

A keyboard 10 comprises keys for designating tone pitches of tones to be generated. Keys depessed in the keyboard 10 are detected by a key assigner 11 and generation of tones corresponding to the depressed keys are any of tone generation channels. The number of the tone generation channels is for example 8 and the respective channels are established by using common tone generation means on a time shared basis. The key assigner 11 produces a key code KC of keys assigned to the respective channels, a key-on signal KON and a key-on pulse KONP on a time shared basis in accordance with channel timing.

An address signal generation circuit 12 receives the key code KC and the key-on pulse KONP from the key assigner 11 and thereupon generates an address signal which changes at a rate corresponding to the tone pitches of the keys assigned to the respective channels on a time shared basis in accordance with the channel timing. This address signal consists, as described above, of the integer section IAD and the decimal section FAD. The integer section IAD consists for example of 18-bit data and designates continuous sample points of a tone waveshape consisting of plural periods prepared in a tone waveshape memory 13. The decimal section FAD is 6-bit data as described above. By way of example, the tone waveshape memory 13 stores data of plural period waveshape of an attack portion and data of plural period waveshape of a sustain portion and the address signal generation circuit 12 generates the address signal, reading out the data of the plural period waveshape of the attack portion once using the key-on pulse KONP as a trigger and thereafter reading out repeatedly the data of the plural period waveshape of the sustain portion. As to the manner of generating the address signal in the address signal generation circuit 1, any method including one in which frequency number is repeatedly operated, a variable frequency dividing method and a method counting a note clock may be employed.

In association with the keyboard 10, a touch detection device 14 is provided for detecting touch of the depressed key.

The tone waveshape memory 13 stores, for example, sampled data of plural period waveshape as described above. The tone waveshape memory 13 stores plural sets of such wavesahpe sampled data in a tone color selection circuit 15 in correspondence to selectable tone colors. The tone waveshape memory 13 may further store plural sets of waveshape sampled data for key scaling control of a tone color in accordance with tone pitch or control of a tone color in accordance with a key touch. For this purpose, tone color selection code TC, key code KC and touch data TD are applied to the tone waveshape memory 13 and a waveshape to be read out is selected in accordance with these data and read out in response to the integer section IAD of the address signal.

The data of the integer section IAD of the address signal generated by the address signal generation circuit 12 is applied to phase address input of the tone waveshape memory 13, not directly but through operators (subtractor 16 and adder 17). These operators 16 and 17 perform a function which is equivalent to sampled data delay means in the digital filter (one corresponding to 4*a* in FIG. 7). More specifically, in this embodiment, sampled data corresponding to the respective integer sections IAD−2, IAD−1, IAD, IAD+1, IAD+2 and IAD +3 of n(=6) sample points are not obtained by actually delaying the sampled data generated by the tone waveshape memory 13 but these sampled data corresponding to the respective integer sections are obtained by generating, on a time shared basis, address data of the respective integer sections IAD 2, IAD−1, IAD, IAD+1, IAD+2 and IAD+3 of (n=6) sample points by adding −2, −1, 0, +1, +2 and +3 to the data of the integer section IAD of the address signal on a time shared basis, and accessing the memory 13 by these address data.

Figure 9:
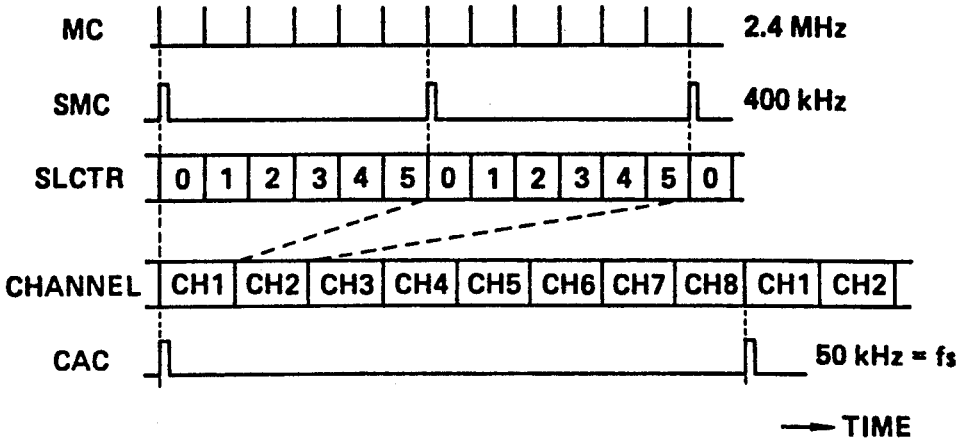
FIG. 9 is a time chart showing timing relations of arithmetic operations and other operations in the embodiment shown in FIG. 8.

FIG. 9 specifically shows an operation timing for performing this operation. In FIG. 9, CAC designates a calculation cycle pulse generated at a period of the sampling frequency fs=50 kHz. Time division timings CH1-CH8 of 8 channels are formed by dividing one period of this pulse by 8 and filter operation time slots for 6 orders are formed by dividing time division time slot of each channel by 6. One period of the filter operation time slot is one period of master clock pulse MC. By counting this master clock pulse MC by a counter of modulo 6, slot count data SLCTR which distinguishes filter operation time slots 0, 1, 2, 3, 4 and 5 in one channel time slot is obtained. SMC designates a filter operation cycle pulse whose one period synchronizes with one channel time slot. If the calculation cycle pulse CAC is 50 kHz, the filter operation cycle pulse SMC is 400 kHz and the master clock pulse MC is 2.4 MHz. These pulses and count data are generated by a master clock generator 22 and a timing signal generation circuit 23.

The subtractor 16 subtracts 2 from IAD for obtaining a value of the integer section IAD−2 which is 2 sample points before the integer section IAD of the current address signal. The data IAD−2 thus obtained is applied to the adder 17 in which the slot count data SLCTR is added. Since this slot count data SLCTR changes 0, 1, 2, 3, 4, 5 within one channel time slot as shown in FIG. 9, address data of the respective integer sections IAD−2, IAD−1, IAd, IAD+1, IAD+2 and IAD +3 of 6 sample points are generated from the adder 17 on a time shared basis in correspondence to 6 filter operation time slots 0, 1, 2, 3, 4 and 5 within one channel time slot. In accordance therewith, sampled data corresponding to the respective integer sections IAD−2, IAD−1, IAD, IAD+1, IAD+2 and IAd+3 of these 6 sample points are read out from the memory 13 on a time shared basis.

The sampled data read out from the memory 13 are applied to a multiplier 18 provided for filter coefficient multiplication. The filter coefficients are supplied from a filter coefficient supply circuit 24 in a manner to be described later in response to the decimal section FAD of the address signal. The output of the multiplier 18 is applied to an accumulator 19 in which sum of convolution is obtained. This accumulator 19 performs accumulation at a timing of the master clock pulse MC (i.e., at each step of the slot count data SLCTR) and is cleared at a timing of the filter operation cycle pulse SMC. Immediately before clearing the accumulated value, the convolution sum obtained by the current operation is latched by a latch circuit 20. The portion including the subtractor 16, adder 17, multiplier 18, accumulator 19 and latch circuit 20 corresponds to a digital filter operation circuit 21 of FIR type. The filter coefficient supply circuit 24 comprises filter coefficient memories 25 and 26 respectively storing filter coefficients of m=96 orders (from 0-th order to 95-th order), selection means 27 for selecting n=6 filter coefficients from among the filter coefficients of 96 orders in accordance with the value of the decimal section FAD of the address signal, and an interpolation circuit 28. The filter coefficient memories 25 and 26 of 2 channels are of the entirely same structure and are provided for parallelly producing adjacent 2 filter coefficients for interpolation in the interpolation circuit 28. The impulse response of filter coefficients stored in these filter coefficient memories 25 and 26 is, for example, as shown in the FIG. 4*c* described above. The filter characteristics realized by this impulse response is, for example, low-pass filter characteristics as shown in FIG. 4*e* or FIG. 5 with the frequency of fs/2=25 kHz which is half of the sampling frequency fs=50 kHz being used as the cut-off frequency.

The selection means 27 determines, in response to the value of the decimal section FAD of the address signal, orders k−FAD−2d, k−FAD−d, k−FAD, k−FAD +d, k−FAD+2d and k−FAD+3d corresponding to the respective integer sections IAD−2, IAD−1, IAD, IAD+1, IAD+2 and IAD+3 of n=6 sample points and selectively reads out filter coefficients h(i−2d), h(i −d), h(i), h(i+d), h(i+2d) and h(i+3d) from the filter coefficient memories 25 and 26 using the determined orders as address signals. The selection means 27 comprises a subtractor 29, a multiplier 30 and adder 31 for performing this determination by arithmetic operation.

Leftmost 4-bit data of the decimal section FAD of the address signal is applied to the subtractor 29 to carry out the subtraction of "15−FAD". To the multiplier 30 is applied the slot count data SLCTR for carryomg out the multiplication of "16×SLCTR". The output of the subtractor 29 and the output of the multiplier 30 are added together by the adder 31 which thereupon produces data indicating the above described orders k−FAD−2d, k−FAD−d, k−FAD, k−FAD+d, k−FAD+2d and k−FAD+3d. Outputs, i.e., orders, of the adder 31 corresponding to values 0–5 of the slot count data SLCTR are shown in the following Table 1. The Table 1 shows also the values of the respective integer sections IAD−2, IAD−1, IAD, IAD+1, IAD+2 and IAD+3 of 6 sample points corresponding to these orders.

TABLE 1

| SLCTR | Integer section of 6 sample points | Output of adder 31 (determined order) |
|---|---|---|
| 0 | IAD − 2 | 15 − FAD |
| 1 | IAD − 1 | 31 − FAD |
| 2 | IAD | 47 − FAD |
| 3 | IAD + 1 | 63 − FAD |
| 4 | IAD + 2 | 79 − FAD |
| 5 | IAD + 3 | 95 − FAD |

It will be understood that if k=47 and d=16, the above defined orders k−FAD 2d, k−FAD−d, k−FAD, k−FAD+d, k−FAD+2d and k−FAD+3*d* become as shown in the above table. Accordingly, the operation circuit in the selection means 27 may be generally constructed so as to execute the operation formula "k−FAD +(SLCTR−2)×d"="47−FAD+(SLCTR−2)=16".

The output of the adder 31 is applied to the filter coefficient memory 25 and also is applied to the filter coefficient memory 26 after 1 is added thereto by an adder 32. Thus, 2 filter coefficient data of adjacent orders are read out from the filter coefficient memories 25 and 26. These 2 filter coefficient data are applied to the interpolation circuit 28 and are subject to interpolation with interpolation characteristics (e.g., linear interpolation characteristics) of 4 steps in response to rightmost 2-bit data of the decimal section FAD of the address signal. Accordingly, although the memories 25 and 26 actually store only filter coefficients of m=96 orders, it is equivalent to preparation of dense stock of filter coefficients of q·m =4×96=384 orders. The output of the interpolation circuit 28 is applied to the multiplier 18. By the interpolation of 4 times, orders of filter coefficients provided by the interpolation circuit 28 at timings of the slot count data SLCTR are virtually changed to values shown in the following Table 2:

TABLE 2

| SLCTR | Integer section of 6 sample points | Orders of outputs of interpolation circuit 28 |
|---|---|---|
| 0 | IAD − 2 | 60 − FAD |
| 1 | IAD − 1 | 124 − FAD |
| 2 | IAD | 188 − FAD |
| 3 | IAD + 1 | 252 − FAD |
| 4 | IAD + 2 | 316 − FAD |
| 5 | IAD + 3 | 380 − FAD |

In Table 1, FAD is modulo 16 (d=16) whereas in Table 2, FAD is modulo 64 (d=64).

The filter operation output signal provided from the latch circuit 20 is applied to a multiplier 33 in which it is multiplied with an amplitude envelope signal supplied from an envelope generator 34. The envelope generator 34 generates, in response to the key-on signal KON, an envelope shape signal controlled in response to the key code KC, tone color selection code TC and touch data TD. The output of the multiplier 33 is applied to an accumulator 35 in which sum of sampled data of all channels is obtained. This accumulator 35 performs accumulation at a timing of the filter operation cycle pulse SMC (i.e., at each channel timing) and is cleared at a timing of the calculation cycle pulse CAC. Immediately before clearing the accumulated value, sum of sampled data of all channels is latched by a latch circuit 36.

The sampling frequency of a tone signal provided by the latch circuit 36 is fs=50 kHz and removal of aliasing noise is ensured by filtering of low-pass filter characteristics in the digital filter operation circuit 21 using the frequency of fs/2=25 kHz as the cut-off frequency. The output signal of the latch circuit 36 is converted to an analog signal by a digital-to-analog converter 37 and thereafter is supplied to a sound system 38. The output signal of the latch circuit 36 is also applied to a digital effect circuit 39 provided for imparting musical effects such as reverberation, echo and other musical effects and the signal imparted with the musical effects is converted to an analog signal by a digital-to-analog converter 37 and supplied to the sound system 38.

The above described decrease in the level of the filter output signal to 1/d=1/16 of the original level can be coped with by storing filter coefficients with level of 16 times as large as the original level in the filler coefficient memories 25 and 26 or shifting coefficient data supplied from the interpolation circuit 28 to the multiplier 18 leftwardly by 4 bits.

An embodiment in which accuracy of the filter operation can be improved without enlarging the scale of the circuit construction as compared to the circuit of FIG. 8 will now be described.

In the embodiment of FIG. 8, for treating tone waveshape sampled data with the sampling frequency fs=50 kHz shown in FIG. 4*a* as data of the sampling frequency in the domain of d·fs=16×50=800 kHz in appearance, the sampled data is processed on the assumption that a sampled value "0" is inserted at a rate of d−1 times per d times of clock of d·fs=800 kHz, the filter operation being omitted with respect to order corresponding to the sampled value "0". In contrast thereto, in the embodiment shown in FIG. 11, tone waveshape sampled data of the sampling frequency fs =50 kHz shown in FIG. 4*a* is interpreted as data which is held at the 0-th order in the domain of d·fs=800 kHz shown in FIG. 10*a* and the simplified filter operation is performed in the same manner as in the previously described embodiment with respect to sampled data having effective values at all sample points of the sampling frequency d·fs=800 kHz.

FIG. 10*b* shows an example of impulse response of low-pass filter characteristics of m=96 orders as in FIG. 4*c*. In the same manner as in the previously described embodiment, convolution sum of the sampled data of FIG. 10*a* and the impulse response of FIG. 10*b* is obtained by causing the phase CAD of the current address signal to correspond to a predetermined reference order k (e.g., intermediate 47-th order). This convolution sum can be expressed generally by the equation:

$$x(\omega_s') = \sum_{i=0}^{95} h(95 - i)W(i)$$

$x(\omega s')$ represents convolution sum corresponding to the phase CAD of the current address signal, $h(95-i)$ filter coefficient and $W(i)$ sampled value in the domain of $d \cdot fs = 800$ kHz, i.e., sampled data at respective sample, points in FIG. 10*a*.

The spectrum envelope of the waveshape shown in FIG. 10*a* is shown in FIG. 10*c*. In this spectrum envelope, unnecessary harmonic components are conveniently attenuated. In the filter output signal obtained according to the above equation also, therefore, unnecessary aliasing component is sufficiently attenuated.

In the above general equation, addition of products of 96 times is necessary. Since the same amplitude continues $d=16$ times in the waveshape sampled data of FIG. 10*a*, the number of times of the addition of products can be reduced to 7 times if operation is performed by treating the same amplitude in package so that the scale of operation can be reduced to one which is proximate to the embodiment of FIG. 8 in which the number of the addition of products is 6 times. More specifically, referring to FIG. 10*a*, since the same waveshape sampled data continues $d=16$ times between the integer section IAD−2 and the integer section IAD −1 of the address signal, a single multiplication of coefficient will suffice for the sampled data in this portion. The same is the case with portions between IAD −1 and IAD, IAD and IAD+1, IAD+1 and IAD+2, and IAD+2 and IAD+3. since the same waveshape sampled data continues a number of times which is smaller than $d=16$ in a portion between IAD−3 and IAD−2, a single multiplication of coefficient can suffice for this portion. The same is the case with a portion between IAD+3 and IAD+4. Accordingly, convolution which is equivalent to the above equation can be obtained by addition of products totalling 7 times.

Figure 11:
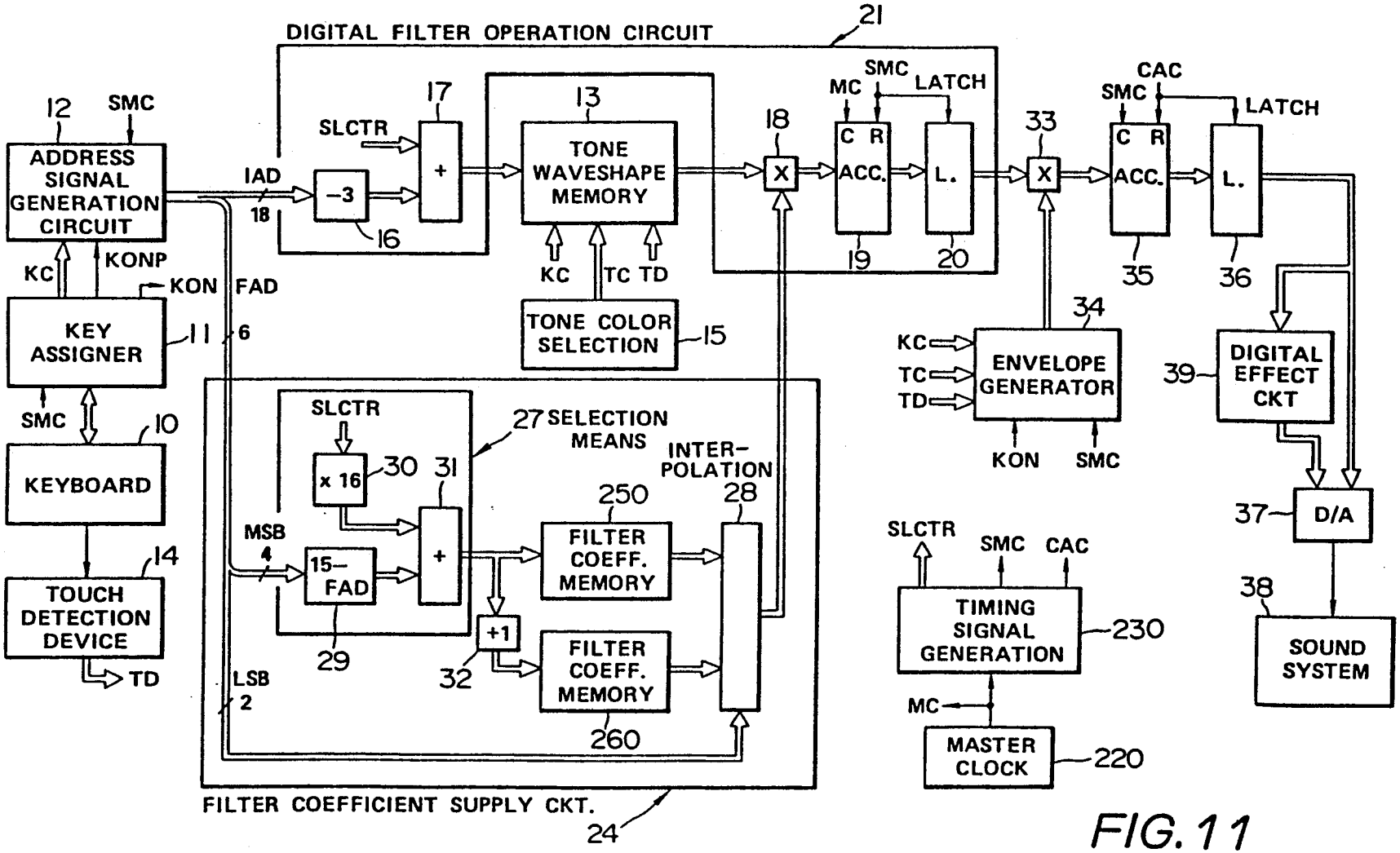
FIG. 11 is a block diagram showing another embodiment of the invention associated with FIG. 10.

For this purpose, in the embodiment of FIG. 11, filter coefficients of orders of maximum $d=16$ corresponding to same waveshape sampled data are previously added together and addition of products is carried out by a single coefficient operation by treating the total of the filter coefficients as a single filter coefficient data. For example, instead of carrying out calculation of $W \cdot h0+W \cdot h2+W \cdot h3+W \cdot h4+W \cdot h5+W \cdot h6$ by multiplication of 7 times, sum of $h0+h1+h2+h3+h4+h5+h6$ is previously prepared and addition of products is obtained by the single multiplication of $W \cdot (h0+h1+h2+h3+h4+h5+h6)$.

In FIG. 11, the same component parts as in FIG. 8 are designated by the same reference characters. Modified portions are subtractor 160, master clock generator 220, timing signal generation circuit 230 and filter coefficient memories 250 and 260 corresponding to subtractor 16, master clock generator 22, timing singal generation circuit 23 in FIG. 8. As described above, in this embodiment, addition of products by 7 times is carried out in the filter operation of one sample point so that 7 filter operation time slots are necessary in one channel time slot and the operation timing is changed as shown in FIG. 12.

Figure 12:
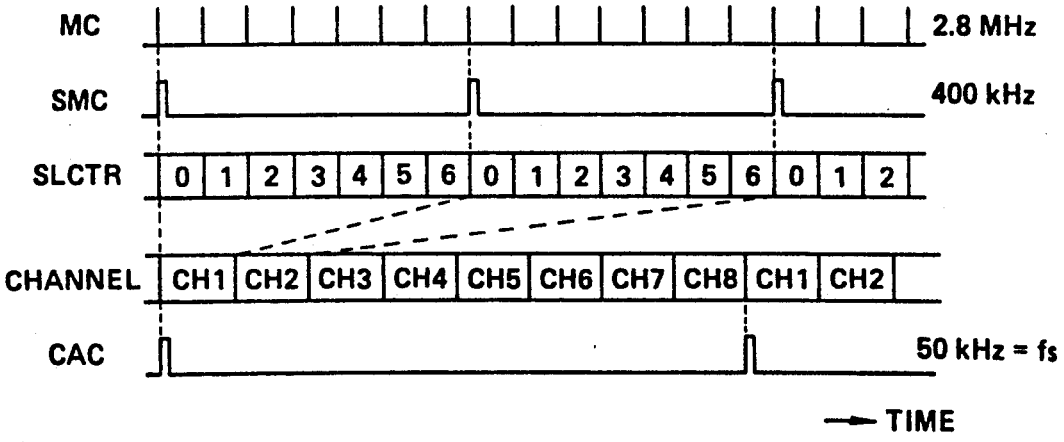
FIG. 12 is a time chart showing timing relations of arithmetic operations and other operations in the embodiment of FIG. 11.

In FIG. 12, the calculation cycle pulse CAC is generated at a period of the sampling frequency $fs=50$ kHz and this one period is divided by 8 to form time division timings CH1–CH8 of 8 channels as in the previously described embodiment. The time division time slot of each channel however is divided by 7 into 7 filter operation time slots. The slot count data SLCTR in this embodiment is modified to distinguish 7 filter operation time slots 0, 1, 2, 3, 4, 5 and 6 within one channel time slot. By counting the master clock pulse MC by a counter of modulo 7, the slot count data SLCTR capable of distinguishing the 7 filter operation time slots 0–6 within one channel time slot is obtained. Accordingly, the frequency of the master clock pulse MC is modified to 2.8 MHz. In accordance with this modification, structures of the master clock generator 220 and the timing signal generation circuit 230 are modified.

Since a single filter operation is performed with respect to sampled data corresponding to integer section of the address signal of 7 sample points, extra sample data corresponding to the integer section IAD−3 which is 3 sample points before the integer section IAD of the current address signal becomes necessary. The subtractor 160 corresponding to the subtractor 16 of FIG. 8, therefore, is modified in such a manner that 3 is subtracted from the integer section IAD of the current address signal to obtain "IAD−3".

The filter coefficient memories 250 and 260 prestore filter coefficient group values corresponding to sums of one or more filter coefficients among filter coefficients of $m=96$ orders. In the same manner as described previously, the memories 250 and 260 have the same memory contents. There are 111 sets of filter coefficient group values prestored in the memories 250 and 260 as shown in Table 3 which consist of sums of filter coefficients of every $d=16$ orders with respect to all orders (consisting of 81 sets which are stored, e.g., at addresses 16–96), sums of filter coefficients of less than $d=16$ orders for the leftward end of the impulse response shown in FIG. 10*b* (consisting of 15 sets which are stored, e.g., at addresses 1–15) and sums of filter coefficients of less than $d=16$ orders for the rightward end of the impulse response (consisting of 15 sets also which are stored, e.g., at addresses 97–111). At address 0 is stored "0" and this is only a matter of design which is necessitated for the reason that the selection means 27 for generating the address data is constructed in the same manner as in FIG. 8. Data of intermediate order (i.e., 47-th order) used as the reference is a sum of filter coefficients of 47-th through 62-nd orders and this data is stored at address 63.

TABLE 3

| Address | Filter coefficient group values |
|---|---|
| 0 | "0" |
| 1 | filter coefficient of 0-th order only |
| 2 | sum of filter coefficients of 0–1st orders |
| 3 | sum of filter coefficients of 0–2nd orders |
| 4 | sum of filter coefficients of 0–3rd orders |
| . | . |
| . | . |
| . | . |
| 14 | sum of filter coefficients of 0–13rd orders |
| 15 | sum of filter coefficients of 0–14th orders |
| 16 | sum of filter coefficients of 0–15th orders |
| 17 | sum of filter coefficients of 1st–16th orders |
| 18 | sum of filter coefficients of 2nd–17th orders |
| 19 | sum of filter coefficients of 3rd–18th orders |
| 20 | sum of filter coefficients of 4th–19th orders |
| . | . |
| . | . |
| . | . |
| 91 | sum of filter coefficients of 75th–90th orders |
| 92 | sum of filter coefficients of 76th–91st orders |
| 93 | sum of filter coefficients of 77th–92nd orders |
| 94 | sum of filter coefficients of 78th–93rd orders |
| 95 | sum of filter coefficients of 79th–94th orders |
| 96 | sum of filter coefficients of 80th–95th orders |
| 97 | sum of filter coefficients of 81st–95th orders |
| 98 | sum of filter coefficients of 82nd–95th orders |
| 99 | sum of filter coefficients of 83rd–95th orders |
| 101 | sum of filter coefficients of 84th–95th orders |

TABLE 3-continued

| Address | Filter coefficient group values |
|---|---|
| . | . |
| . | . |
| . | . |
| 109 | sum of filter coefficients of 93rd–95th orders |
| 110 | sum of filter coefficients of 94th–95th orders |
| 111 | filter coefficient of 95th order only |

In this construction, data provided from the adder 31 of the selection means 27 in correspondence to values 0–6 of the slot count data SLCTR does not represent orders themselves but addresses of the filter coefficient memories 250 and 260 as shown in Table 3. Values of coefficient memory address data provided from the adder 31 of the selection means 27 in correspondence to values 0–6 of the slot count data SLCTR in response to the decimal section FAD of the address signal are shown in the following Table 4. This table shows also corresponding integer sections IAD−3, IAD−2, IAD−1, IAD, IAD+1, IAD+2 and IAD+3 of 7 sample points.

The concept of memory reading in this embodiment is, as in the previously described embodiment, to cause coefficient data stored at address 63 corresponding to an intermediate order (47-th order) used as the reference to correspond to the decimal section FAD of the current address signal, determine skippingly 7 coefficient memory addresses spaced from the reference address 63 by amounts corresponding to distances of the respective integer sections IAD−3, IAD−2, IAD−1, IAD, IAD+1, IAD+2 and IAD+3 of 7 sample points from the decimal section FAD of this current address signal, and read out 7 sets of filter coefficient group value data from the 7 coefficient memory addresses thus determined. Further, as in the previously described embodiment, filter coefficient group value data of adjacent addresses are parallelly read out from the two memories 250 and 260 and interpolation is performed between the two data.

TABLE 4

| SLCTR | Integer section of 7 sample points | Output of adder 31 (coefficient memory address) |
|---|---|---|
| 0 | IAD − 3 | 15 − FAD |
| 1 | IAD − 2 | 31 − FAD |
| 2 | IAD − 1 | 47 − FAD |
| 3 | IAD | 63 − FAD |
| 4 | IAD + 1 | 79 − FAD |
| 5 | IAD + 2 | 95 − FAD |
| 6 | IAD + 3 | 111 − FAD |

Referring to Tables 3 and 4, if, for example, the decimal section FAD of the address signal is "6", the coefficient memory address is 9 when SLCTR is 0 and sum data of filter coefficients of 0-th to 8-th orders is read out from the filter coefficient memory 250. When SLCTR is 1, the address is 25 and sum data of filter coefficients of 9-th to 24-th orders is read out. When SLCTR is 2, the address is 41 and sum data of filter coefficients of 25-th to 40-th orders is read out. When SLCTR is 3, the address is 57 and sum data of filter coefficients of 41st to 56-th orders is read out. When SLCTR is 4, the address is 73 and sum data of filter coefficients of 57-th to 72-nd orders is read out. When SLCTR is 5, the address is 89 and sum data of filter coefficients of 73-rd to 88-th orders is read out. When SLCTR is 6, the address is 105 and sum data of filter coefficients of 89-th to 95-th orders is read out. In the foregoing manner, all filter coefficients of 0-th to 95-th orders are covered by seven filter coefficient group values.

As described in the foregoing, according to the embodiment of FIG. 11, the operation for obtaining sum of addition of products of all of filter coefficients of m=96 orders with respect to sampled data held at 0-th order in the domain of d·fs=800 kHz as shown in FIG. 10*a* can be actually accomplished by operation of only 7 times. Accordingly, accurate filter operation can be performed using waveshape data of spectrum structure in which aliasing component is sufficiently attenuated.

In the embodiments of FIGS. 8 and 11, the operators controlling address of the tone waveshape memory 13 is provided in the digital filter operation circuit 21 as means for delaying sampled data instead of actually providing a delay circuit. Alternatively, a delay circuit may actually be provided as shown in FIG. 7.

As tone waveshape sampled data generation means, the tone waveshape memory 13 storing plural period waveshape is provided. The tone waveshape sampled data generation means however is not limited to this but any other system such as a tone waveshape memory storing merely a waveshape of one period, a system for generating tone waveshape sampled data by frequency modulation operation, a system for generating tone waveshape sampled data by amplitude modulation operation and a system for generating tone waveshape sampled data by data converting address data may be employed.

In the above embodiments, the tone generation and filter operation in the respective channels are carried out on a time shared basis. These processings may however be carried out by parallel processings. The invention is applicable to not only a polyphonic tone generation system but also a monophonic tone generation system.

For selecting a waveshape corresponding to the tone color selection code TC, key code KC and touch data TD in the tone waveshape memory 13 in the embodiments of FIGS. 8 and 11, these data may be applied to the address signal generation circuit 12 instead of the tone waveshape memory 13 and the address signal generation circuit 12 may be modified so that it can select these data by leftmost bits of the address signal.

In the case of the impulse response which is symmetrical with respect to the intermediate order as in FIG. 4*c* or 10*b*, filter coefficients for all orders need not be stored in the memory but, instead, half of the filter coefficients may be stored and one filter coefficient may be commonly used for also a filter coefficient of the same value located at the symmemtrical position at a different order.

The filter coefficient memories 25 and 26 or 250 and 260 may be combined into one memory and 2 adjacent coefficient data for the interpolation may be read out on a time shared basis. In that case, the frequency of the master clock pulse MC is doubled and 2 time division time slots for the interpolation are formed within one filter operation time slot.

In the embodiments of FIGS. 8 and 11, the filter coefficients read out from the memory are interpolated in 4 steps. The number of interpolation steps is not limited to this. The interpolation itself may even be omitted.

The type of filter operation is not limited to the above described FIR type but IIR (infinite impulse response) type or other type of filter may be employed.

The digital filter used in the present invention is applicable not only to the removal of aliasing noise as in the above described embodiments but also to other purposes including tone color control. In this case, an arrangement should be made so that filter characteristics may be selected in accordance with the tone color selection code TC, key code KC and toch data TD. More specifically, plural filter coefficient data corresponding to plural filter characteristics are respectively stored in a filter coefficient memory, a set of filter coefficient data which can realize a desired tone color is selected in accordance with the tone color selction code TC, key code KC and touch data TD and this set of filter coefficients is read out in response to the decimal section of the address signal.

In key scaling control responsive to key code KC or tone color control responsive to touch data TD, a reduced number of filter coefficient data may be prestored in the memory and filter coefficient data may be densely produced by interpolating these filter coefficient data in response to the key code KC and touch data TD.

The tone signal generation device according to the invention may be provided in plural systems and tone signals generated in these channels may be synthesized by interpolation in response to the key code KC and touch data TD.

In the above described embodiments, tone waveshape sampled data is generated by the pitch non-synchronization system in which the sampling frequency is constant regardless of pitch of a tone signal. The invention is applicable also to a case in which tone waveshape sampled data is generated by the pitch synchronization system in which the sampling frequency synchronizes with pitch of a tone signal.

Instead of reading out all of waveshape sampled data stored in the tone waveshape memory, the address signal may be controlled in such a manner that the data will be read out intermittently in a high frquency region, e.g., every other times or once in 4 times.

In sum, according to the invention, tone waveshape sampled data is generated in accordance with the integer section of the address signal which changes in accordance with tone pitch of a tone to be generated, n coefficient data among coefficient data corresponding to filter coefficients of m orders ($n<m$) are selected in response to the decimal section of the address signal and filter operations of m orders are performed with respect to tone waveshape data of n sample points by using tone waveshape data of n sample points generated in correspondence to the integer section of the address signal. The invention therefore produces the following advantageous results: (1) The resolution of tone waveshape sampled data actually prepared in the tone waveshape data generation means may be a relatively coarse one corresponding to the integer section of the address signal. The circuit construction therefore can be simplified. (2) The filter operation may be made actually with respect to limited number of orders corresponding to tone waveshape data of n sample points which n is smaller than m. The circuit construction of the digital filter circuit can also be simplified. (3) The filter operation substantially becomes equivalent to an accurate filter operation of m orders made with respect to tone waveshape sampled data of high accuracy having resolution of the decimal section of the address signal. This contributes to various advantages brought about by a filter operation performed with respect to tone waveshape sampled data of high resolution including the advantage that removal of an unnecessary noise component is ensured with resulting production of a tone signal of high quality.

What is claimed is:

1. A tone signal generation device comprising:
means for generating a binary address signal whose value changes at a rate corresponding to the tone pitch of a tone to be generated;
tone waveshape data generation means responsive to a first part of said address signal for generating a tone waveshape in the form of a sampled value;
filter coefficient supply means for supplying an integer number n of filter coefficients in response to a second part of said address signal;
digital operation means, having a structure of an integer order m, where $n<m$ for digital filtering of said tone waveshape in accordance with said integer number n of filter coefficients.

2. A tone signal generation device as set out in claim 1, wherein M is a predetermined constant integer and n varies with the value of said first part of said binary address signal.

3. A tone signal generation device comprising:
address signal generation means for generating an address signal comprising an integer section and a decimal section, the value of said address signal changing at a rate corresponding to the tone pitch of a tone to be generated;
tone waveshape data generation means responsive to said integer section for generating a tone waveshape in the form of sampled value;
filter coefficient supply means capable of supplying an filter coefficients from among a group of m filter coefficients in response to said decimal section (wherein n and m are integers and $n<m$); and
a digital filter operation means having an m-order structure for digital filtering of said tone waveshape in accordance with said n filter coefficients.

4. A tone signal generation device as defined in claim 3 wherein said filter coefficient supply means comprises filter coefficient generation means for generating said m filter coefficients and selection means for selecting said n filter coefficients in response to said decimal section of the address signal.

5. A tone signal generation device as defined in claim 3 wherein said filter coefficients correspond to successive values of said address signal respectively and wherein said filter coefficient supply means selects a predetermined reference order which corresponds to the decimal section of a current version of said address signal, wherein said filter coefficient supply means determines n orders which are distant from the reference order by amounts corresponding to intervals of respective integer sections of n sample points to the decimal section of said current address signal and said filter coefficient supply means supplies said n filter coefficients corresponding to the n orders thus determined in response to the decimal section of the current address signal.

6. A tone signal generation device as defined in claim 3 wherein n is determined with a relation $n=m/d$ in accordance with a dividing number d of said decimal section of said address signal, said n filter coefficients correspond to the n orders which are sequentially distant with an interval of d, the n orders are determined respectively in response to values of the decimal sections of the current address signal and said filter coefficient supply means supplies said n filter coefficients corresponding to the n orders thus determined in response to the decimal section of the current address signal.

7. A tone signal generation device as defined in claim 3 wherein the coefficient data corresponding to the filter coefficient data of m orders is a filter coefficient group value corresponding to a total of one or more of the filter coefficients of m orders; and said filter coefficient supply means selects and supplies the filter coefficient group values of n groups (where $n<m$) in response to the decimal section of the address signal.

8. A tone signal generation device as defined in claim 7 wherein said filter coefficient supply means comprises filter coefficient generation means for generating the filter coefficient group values corresponding to plural groups and selection means for selecting filter coefficient values of n groups among the filter coefficient group values corresponding to these plural groups in response to the value of the decimal section of the address signal.

9. A tone signal generation device as defined in claim 7 wherein respective orders of the filter coefficients of m orders correspond to continuous values of the address signal with resolution of the decimal section and wherein said filter coefficient supply means selects a predetermined reference order which corresponds to the decimal section of the address signal, wherein said filter coefficient supply means determines n orders which are distant from the reference order by amounts corresponding to intervals of respective integer sections of n sample points to the decimal section of the address signal, wherein filter coefficient group values of n groups are obtained by summing filter coefficient of orders which exist between the respective sample points at each order corresponding to each of the sample points thus determined, and said filter coefficient supply means supplies the filter coefficient group values of n groups thus determined in response to the decimal section of the current address signal.

10. A tone signal generation device comprising:

address signal generation means for generating an address signal comprising an integer section and a decimal section and changing at a rate corresponding to tone pitch of a tone to be generated;

tone waveshape data generation means for generating tone waveshape sampled data in response to the integer section of the address signal;

filter coefficient supply means responsive to the decimal section of the address signal for selecting and supplying coefficient data corresponding to non-continuous n orders from among coefficient data corresponding to filter coefficients of m orders (wherein n and m are integers and $n<m$); and digital filter operation means for performing a digital filter operation by using said coefficient data corresponding to the non-continuous n orders supplied by said filter coefficient supply means and the tone waveshape sampled data generated by said tone waveshape data generation means.

11. A tone signal generation device comprising:

address signal generation means for generating an address signal comprising an integer section and a decimal section and changing at a rate corresponding to tone pitch of a tone to be generated;

tone waveshape data generation means for generating tone waveshape sampled data in response to the integer section of the address signal;

filter coefficient supply means capable of supplying filter coefficient group values each corresponding to a total of one or more filter coefficients among filter coefficient group values each corresponding to a total of one or more filter coefficients among filter coefficients of m orders and selecting and supplying the filter coefficient group values of n groups (where n and m are integers and $n<m$) in response to the decimal section of the address signal; and digital filter operation means for performing filter operations of m orders with respect to tone waveshape data of n sample points by using said filter coefficient values of n groups supplied by said filter coefficient supply means and tone waveshape data of n sample points generated by said tone waveshape data generation means.

* * * * *